US011497325B2

(12) United States Patent
Peters et al.

(10) Patent No.: US 11,497,325 B2
(45) Date of Patent: Nov. 15, 2022

(54) VERTICALLY STACKABLE, LATERALLY EXTENDABLE MERCHANDISE DISPLAY SYSTEM

(71) Applicant: Bruegmann USA, Inc., Houston, TX (US)

(72) Inventors: Christopher Peters, Houston, TX (US); Lars Bruegmann, Dortmund (DE)

(73) Assignee: Bruegmann USA, Inc., Houston, TX (US)

( * ) Notice: Subject to any disclaimer, the term of this patent is extended or adjusted under 35 U.S.C. 154(b) by 0 days.

(21) Appl. No.: 17/529,929

(22) Filed: Nov. 18, 2021

(65) Prior Publication Data

US 2022/0151402 A1 May 19, 2022

Related U.S. Application Data

(60) Provisional application No. 63/115,100, filed on Nov. 18, 2020.

(51) Int. Cl.
*A47F 5/10* (2006.01)
*A47F 1/12* (2006.01)

(52) U.S. Cl.
CPC . *A47F 5/10* (2013.01); *A47F 1/12* (2013.01)

(58) Field of Classification Search
CPC .... A47F 5/10; A47F 1/12; A47F 1/125; A47F 1/126
See application file for complete search history.

(56) References Cited

U.S. PATENT DOCUMENTS 2,901,120 A * 8/1959 Abrahamson ..... B42F 7/12 211/126.12
3,152,697 A * 10/1964 Berman ..... A47F 1/082 211/59.2

(Continued)

FOREIGN PATENT DOCUMENTS

CA 2530923 A1 * 6/2007 ..... A47F 1/12
CH 602440 A5 * 7/1978

(Continued)

OTHER PUBLICATIONS

International Search Report and Written Opinion dated Mar. 4, 2022, for International application No. PCT/US2021/059893.

*Primary Examiner* — Stanton L Krycinski
(74) *Attorney, Agent, or Firm* — Richard A. Fagin

(57) ABSTRACT

A modular product display system has at least two vertically stacked layers. Each layer has at least one roller track supported on one longitudinal end by a rail such that the one longitudinal end is at a different elevation than the other longitudinal end. At least two vertical stacking side barriers are disposed at laterally spaced apart positions between the roller track in each of the vertically stacked layers. The vertical stacking side barriers have protrusions on an upper edge and a lower edge engageable with corresponding openings in the roller track. Either (i) the protrusions on at least one of the upper edge and the lower edge are displaced from a plane of the vertical stacked side barrier, or (ii) the vertical stacked side barriers between the at least two vertically stacked layers are laterally displaced from vertical stacked side barriers between further vertically stacked layers.

15 Claims, 12 Drawing Sheets

(56) References Cited

U.S. PATENT DOCUMENTS 3,393,808 A * 7/1968 Chirchill ..... A47F 1/087 193/27
3,784,022 A * 1/1974 Beesley, Jr. ..... A47F 1/087 193/27
3,902,633 A * 9/1975 Spengler ..... A47F 5/13 221/92
4,105,126 A * 8/1978 Deffner ..... A47F 1/12 211/85.18
4,138,015 A * 2/1979 Rabley ..... A47B 87/0261 206/821
4,228,903 A * 10/1980 Eckert ..... A47F 1/12 211/194
4,270,661 A * 6/1981 Rosenband ..... A47F 1/12 211/191
RE30,706 E * 8/1981 Bustos ..... A47F 1/12 211/59.2
4,356,923 A * 11/1982 Young ..... A47F 1/12 211/184
4,394,910 A * 7/1983 Miller ..... B65G 1/023 211/151
4,441,615 A * 4/1984 Goodrich ..... B65D 21/041 206/505
4,474,297 A * 10/1984 Zucker ..... A47F 1/12 211/184
4,562,927 A * 1/1986 Fredrickson ..... G09F 15/00 312/257.1
4,763,796 A * 8/1988 Flum ..... A47F 1/12 211/186
4,785,943 A * 11/1988 Deffner ..... A47F 5/005 211/128.1
4,886,171 A * 12/1989 Spamer ..... A47F 7/28 211/74
4,901,872 A * 2/1990 Lang ..... A47B 87/0223 211/188
4,981,224 A * 1/1991 Rushing ..... A47B 87/0223 211/126.12
5,259,518 A * 11/1993 Sorenson ..... B65G 1/023 211/151
5,279,430 A * 1/1994 Benton ..... B65G 1/023 211/151
5,295,591 A * 3/1994 Slater ..... A47B 47/027 211/151
5,417,333 A * 5/1995 Flum ..... A47B 87/007 211/194
5,749,477 A 5/1998 Chang
5,797,502 A * 8/1998 Brady ..... A47B 57/40 211/183
5,865,324 A * 2/1999 Jay ..... A47F 1/12 211/74
5,971,826 A * 10/1999 Delzompo ..... A47F 5/10 211/184
6,186,345 B1 * 2/2001 Robertson ..... A47F 1/12 211/184
6,405,880 B1 * 6/2002 Webb ..... A47F 1/12 211/187
6,675,979 B2 1/2004 Taylor
6,732,858 B1 5/2004 Chang Ou
6,880,708 B2 * 4/2005 Boron ..... A47F 1/12 211/74
6,991,115 B2 * 1/2006 Chow ..... G11B 33/0483 211/188
D530,540 S * 10/2006 Stravitz ..... D6/675.4
7,617,941 B2 * 11/2009 Colin ..... A47F 5/13 206/503
7,762,410 B2 * 7/2010 Colin ..... A47B 57/20 211/187
8,251,233 B1 * 8/2012 Biglow ..... A47F 1/12 211/187
9,016,483 B2 * 4/2015 Howley ..... A47F 1/126 211/59.3
9,038,804 B1 * 5/2015 Nickell ..... A47B 96/021 211/151
9,266,678 B2 * 2/2016 Nickell ..... A47F 5/0043
10,010,170 B2 7/2018 Ryner et al.
10,064,500 B2 * 9/2018 Furui ..... A47F 1/12
10,159,359 B2 * 12/2018 Borg ..... B65G 1/023
10,251,493 B2 * 4/2019 Kim ..... B65G 1/023
10,881,199 B1 * 1/2021 Le ..... A47B 88/417
11,076,690 B2 * 8/2021 Sudds ..... A47B 47/00
2004/0178156 A1 * 9/2004 Knorring, Jr. ..... A47F 1/12 211/151
2005/0162051 A1 * 7/2005 Madsen ..... A47B 87/0284 312/287
2006/0043034 A1 * 3/2006 Vanderslice ..... A47F 1/12 211/85.18
2006/0060547 A1 * 3/2006 Chang ..... A47F 1/12 211/73
2007/0215566 A1 * 9/2007 Shen ..... A47F 7/005 211/85.5
2008/0197089 A1 * 8/2008 Chang ..... A47F 1/12 211/59.2
2010/0133214 A1 * 6/2010 Evans ..... A47F 1/12 211/49.1
2010/0206829 A1 * 8/2010 Clements ..... A47F 1/12 211/184
2011/0114578 A1 * 5/2011 Jacobs ..... A47F 1/12 211/59.2
2012/0217212 A1 * 8/2012 Czalkiewicz ..... A47F 1/12 211/59.2
2012/0285916 A1 * 11/2012 O'Quinn ..... A47F 1/12 211/151
2020/0138207 A1 * 5/2020 Mishly ..... B65G 1/00

FOREIGN PATENT DOCUMENTS

FR 2867369 A1 * 9/2005 ..... A47F 1/12
GB 814714 A * 6/1959
JP 2011-143064 A 7/2011

* cited by examiner

VERTICALLY STACKABLE, LATERALLY EXTENDABLE MERCHANDISE DISPLAY SYSTEM

CROSS REFERENCE TO RELATED APPLICATIONS

Priority is claimed from U.S. Provisional Application No. 63/115,100 filed on Nov. 18, 2020 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of merchandise displays. More specifically, the disclosure relates to displays that can be assembled from modules to provide selectable lateral and vertical dimension display systems.

Merchandise displays known in the art include displays comprising one or more roller tracks on a bottom surface to facilitate forward moving of product containers disposed on the display by gravity. One such roller track is sold under the trademark FLEXROLLER, which is a registered trademark of Bruegmann USA, Inc., Houston, Tex. One or more such roller tracks may be supported on a display base, or may be laterally joined and supported to create the display base. One longitudinal end of the roller track(s) may be raised relative to the other longitudinal end so that gravity may act to move product containers longitudinally as product containers are removed from the roller track(s) such as by product purchasers.

It is desirable to have a modular display system that enables combining selected numbers of roller tracks in display systems in both lateral (horizontal) and vertical directions to enable using the roller tracks for various sizes and styles of product containers in a single display system, or to enable separation of the display system into compartments to facilitate product container loading and removal.

SUMMARY

One aspect of the present disclosure is a modular display system. A modular product display system according to this aspect of the disclosure has at least two vertically stacked layers. Each layer has at least one roller track supported on one longitudinal end by a rail such that the one longitudinal end is at a different elevation than the other longitudinal end. At least two vertical stacking side barriers are disposed at laterally spaced apart positions between the roller track in each of the vertically stacked layers. The vertical stacking side barriers have protrusions on an upper edge and a lower edge engageable with corresponding openings in the roller track. Either (i) the protrusions on at least one of the upper edge and the lower edge are displaced from a plane of the vertical stacked side barrier, or (ii) the vertical stacked side barriers between the at least two vertically stacked layers are laterally displaced from vertical stacked side barriers between further vertically stacked layers.

Other aspects and possible advantages will be apparent from the description and claims that follow.

DETAILED DESCRIPTION

Figure 1:
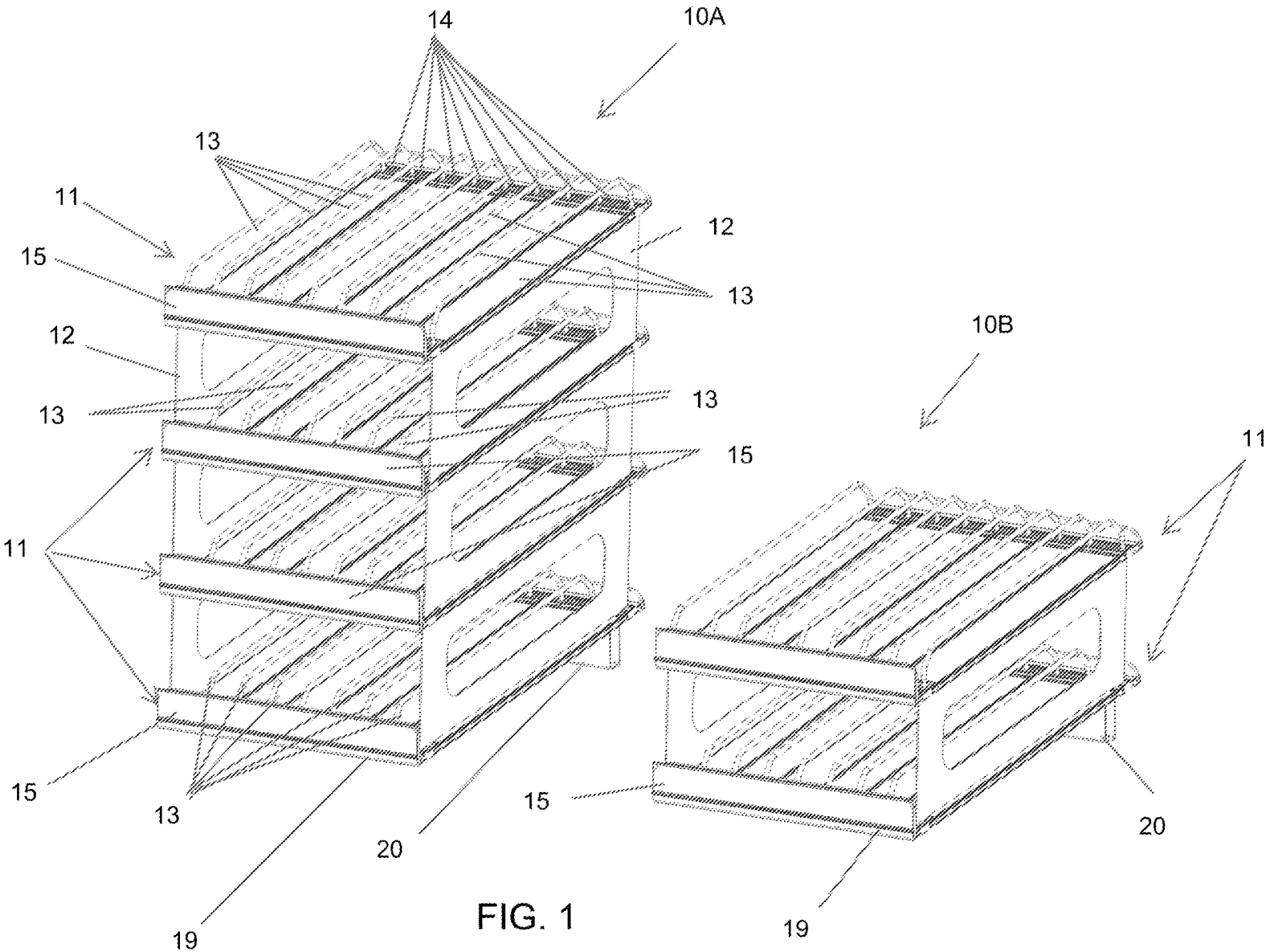
FIG. 1 shows an oblique view of two, vertically stacked display assemblies according to the present disclosure.

FIG. 1 shows an oblique view of two different configurations of display assemblies according to the present disclosure. A first display assembly 10A may comprise at least two, and in the present example embodiment four, vertically stacked roller track layers 11. Each such roller track layer ("layer") 11 may comprise one or more roller tracks 14. In any layer comprising more than one roller track 14, the roller tracks 14 may be disposed side by side. Roller tracks suitable for use with a display according to the present disclosure include, for example and without limitation, the FLEXROLLER brand roller track set forth in the Background section herein. The bottom most layer 11 may be supported at one end, e.g., the back longitudinal end by a brace or bracket 20. In the present example embodiment, the bracket 20 may form the only structural substrate for the bottom most layer 11. The bracket 20 may dispose the back longitudinal end of the first display assembly 10A higher than the front longitudinal end so that product containers disposed on the one or more roller tracks 14 are urged toward the front longitudinal end of the first display assembly 10A by gravity. The front longitudinal end may comprise a front barrier 15 on any or each layer 11 to limit forward movement of product containers disposed on the roller track 14. A vertical stacking side barrier 12 may be disposed on the laterally outward most edges of the roller track(s) 14, that is, there may be one such vertical stacking side barrier 12 on each lateral edge of the first display assembly 10A between adjacent layers 11. If there is a plurality of roller tracks 14 in any respective layer 11, then adjacent roller track edges inward of the laterally outward most edges may comprise a lane divider 13 to separate product "lanes" on respective roller tracks 14. In some embodiments, the lane dividers 13 may be disposed at any other lateral position along the relevant roller track 14. The lane dividers 13 may be in the form of an open wire loop (see FIG. 7 and FIG. 8) or may be panel type barriers. Depending on the width of the product containers to be disposed in any layer 11, lane dividers 13 may be included or omitted at any one or more lateral locations within any layer 11. The number of lane dividers 13 may be different between or among different layers 11.

The vertical stacking side barriers 12 may provide lateral limit to movement of product containers disposed on the roller track(s) 14, and at the same time provide vertical spacing between vertically adjacent layers 11 in any display assembly having more than one layer. In the example embodiments shown in FIG. 1, the uppermost layer 11 may comprise only lane dividers 13, including on both the laterally outward most edges of the uppermost layer 11 because no other layer is affixed above the uppermost layer 11. The vertical stacking side barriers 12 may be disposed, for example, on the lateral edges of each layer 11 between any two vertically adjacent, stacked layers 11. The height of the vertical stacking side barriers 12 may be different in various embodiments, and may be chosen to suit the vertical dimension of product containers intended to be disposed on the various display assemblies 10A, 10B. The display assemblies shown in FIG. 1 each comprises only one lateral "module", wherein a lateral module for purposes of this disclosure comprises all components disposed between vertical stacking side barriers 12 in any layer 11. In versions of a display assembly that have a plurality of roller tracks 14 disposed side by side in each module, the roller tracks 14 may be supported laterally by a rail 19 at each longitudinal end. The bracket 20 may perform the support function of the rail at the rear longitudinal end in some embodiments, and thus a rear rail may be omitted. In embodiments such as shown in FIG. 1, a front barrier 15 may attach to the front rail 19. The front barrier 15 may limit forward movement of product containers disposed on any embodiment of display assembly, e.g., the first display assembly 10A.

In FIG. 1, the first display assembly 10A may comprise four layers 11. The second display assembly 10B may comprise two layers 11. The number of layers in any display assembly in any embodiment is a matter of discretion for the user and is not a limitation on the scope of the present disclosure. The lateral dimensions of any of the layers 11 within any display assembly 10A or 10B may also be of different extent to any of the rest of the layers 11 within said assembly 10A or 10B.

Figure 2:
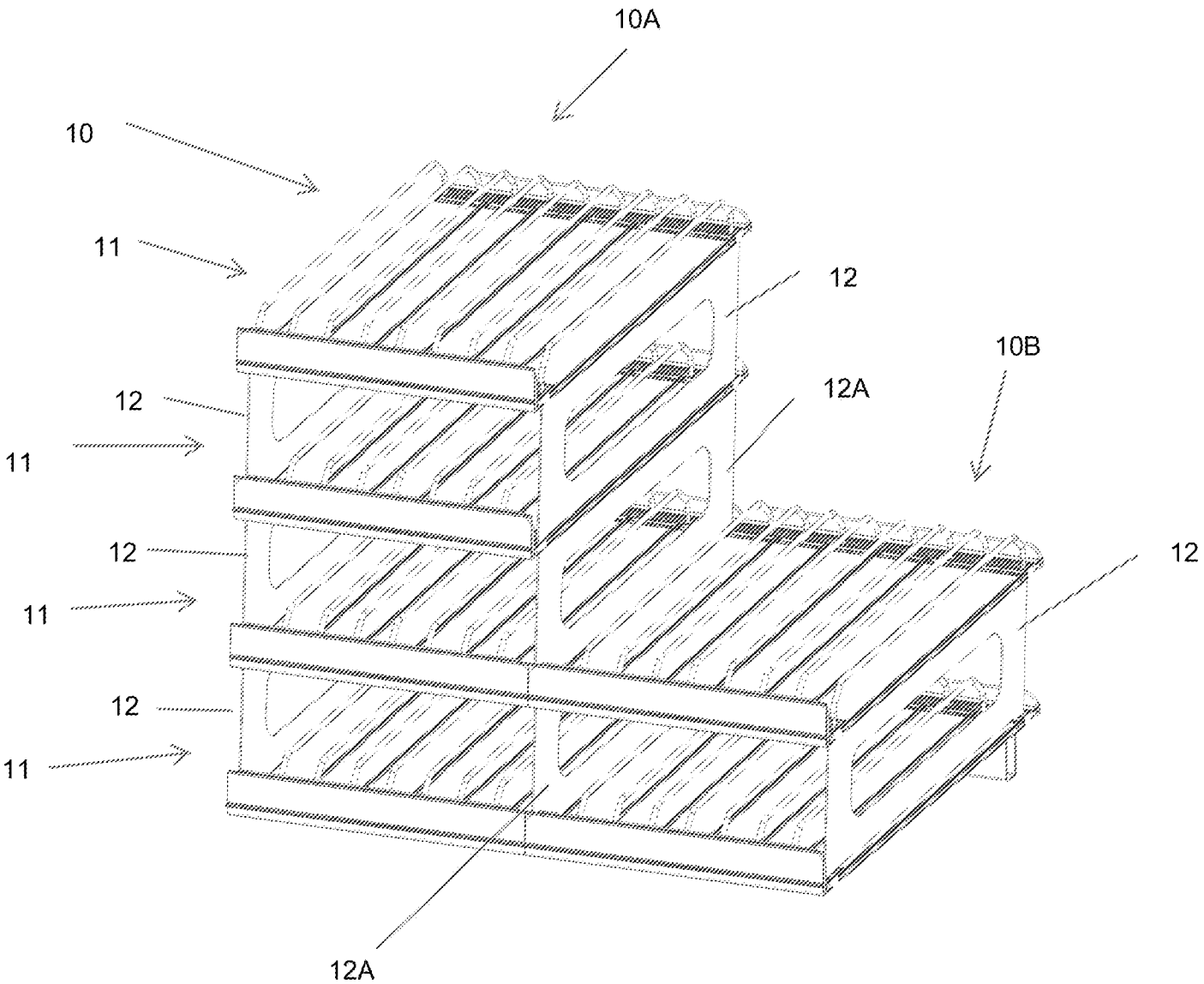
FIG. 2 shows two, vertically stacked, horizontally joined display assemblies as in FIG. 1.

Another example embodiment of a display is shown in FIG. 2. The example embodiment shown in FIG. 2 comprises two display assemblies, which may be substantially as shown in FIG. 1, the difference between the embodiments in FIG. 1 and FIG. 2 being that the display assemblies 10A, 10B are connected or joined laterally to form a display system 10. Lateral joining may be obtained, for example, by using interlocking, vertical stacking vertical side barriers 12A to lock together laterally adjacent display assemblies 10A, 10B. The outermost lateral positions of the display system 10, which are not interlocked or connected to any other laterally adjacent display assembly, may comprise vertical stacking side barriers 12 similar in structure to those used in the embodiments shown in FIG. 1. FIG. 2 shows two such laterally connected display assemblies 10A, 10B. The number of layers 11 in any display assembly may be as shown in FIG. 2, however, the number of laterally connected or interlocked display assemblies and the number of layers in each such display assembly as shown in FIG. 2 are not intended to limit the scope of the present disclosure. The interlocking, vertical stacking side barriers 12A and variants thereof will be explained in further detail below.

Figure 3:
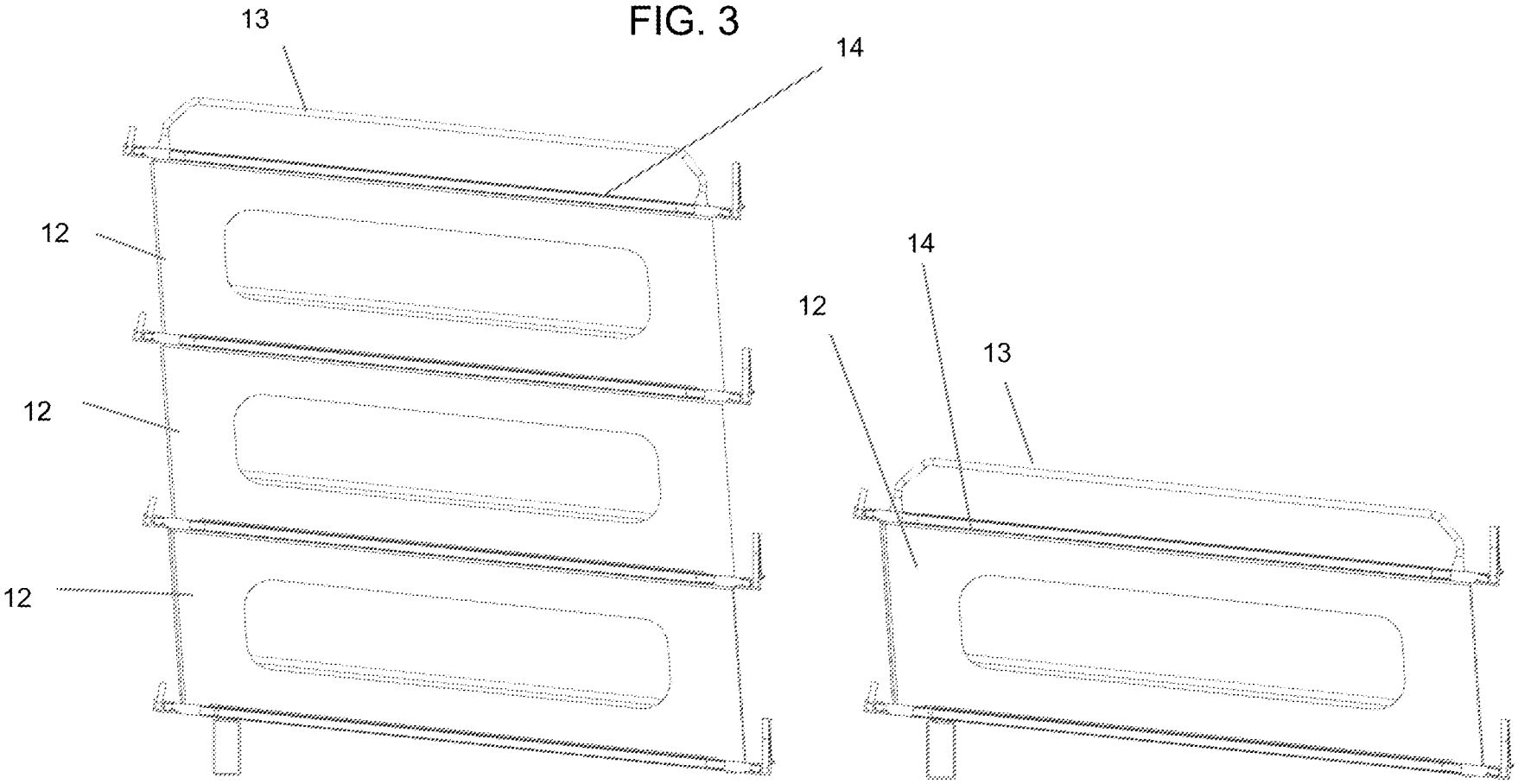
FIG. 3 shows various forms of side barrier used in the assemblies in FIGS. 1 and 2.
Figure 19:
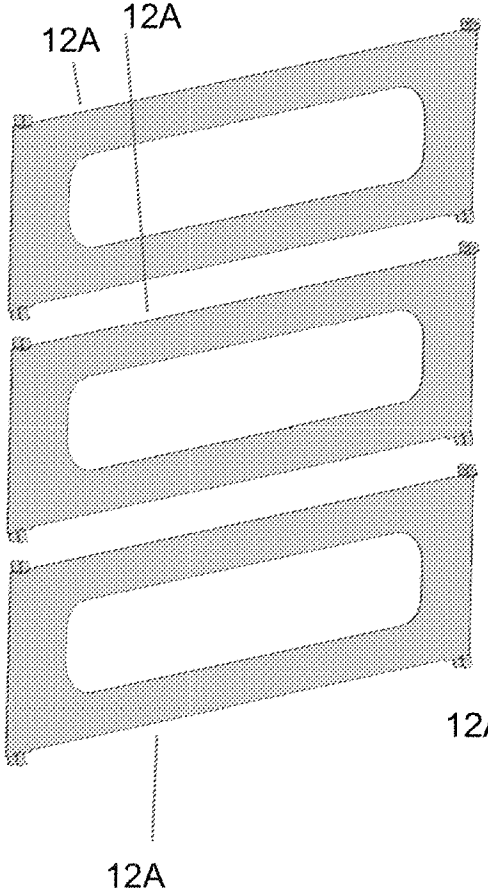

FIG. 3 shows a partial side view of the embodiments shown in FIG. 1 to provide some additional detail concerning example embodiments of the vertical stacking side barriers 12 and the lane dividers 13. A lane divider 13, as explained with reference to FIG. 1, may be disposed on the laterally outward most position(s) on the topmost roller track(s) 14. A vertical stacking side barrier 12 may be disposed in the corresponding lateral positions between any two vertically adjacent layers (11 in FIG. 1). In some embodiments, the vertical stacking side barriers 12 may be parallelogram shaped as shown in FIG. 3 and as may also be observed in FIG. 19 to enable truly vertical stacking of layers 11, or the upper edge and lower edge of the vertical stacking side barriers may be longitudinally displaced to enable "waterfall" vertical stacking of layers 11. A lane divider 13 may be disposed at any intermediate lateral position on any of the roller tracks 14 in any of the layers 11.

Figure 4:
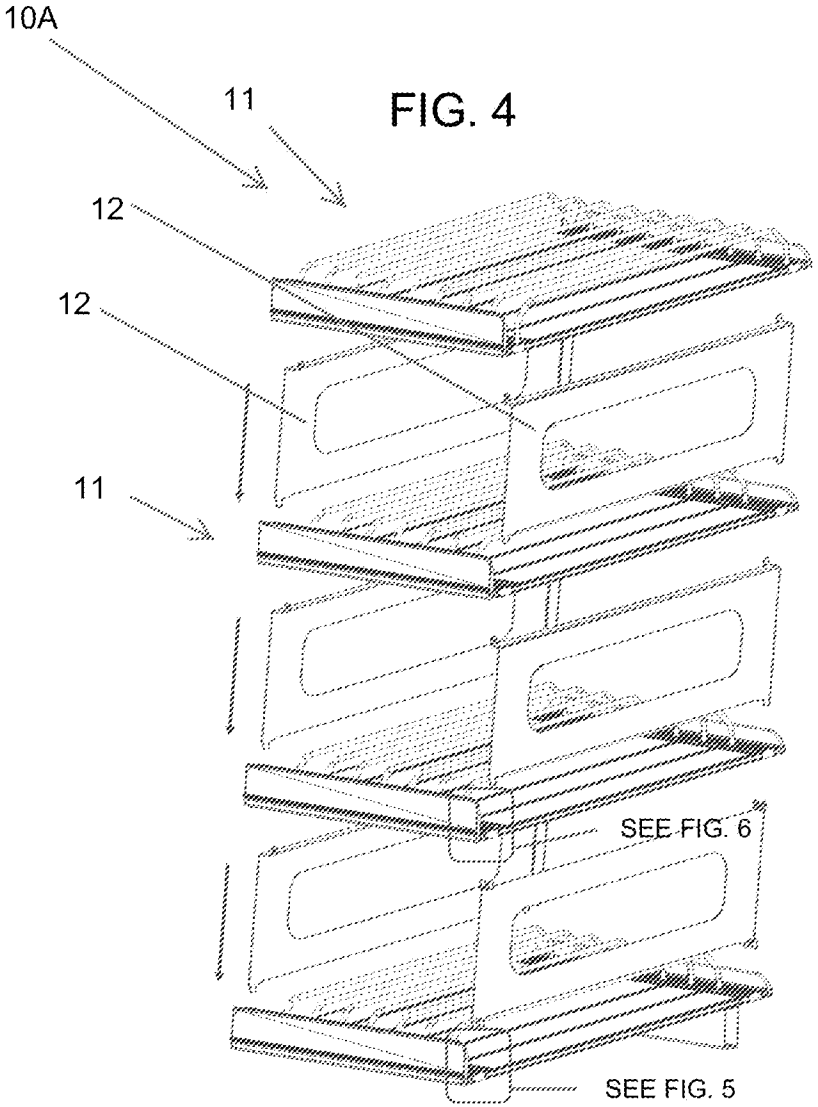
FIG. 4 shows the left hand side of the vertically stacked display assembly as in FIG. 1.

FIG. 4 shows an exploded view of the embodiment of the display assembly shown in the left hand side of FIG. 1, namely, the first display assembly 10A comprising four vertically stacked layers 11. The layers 11 may be assembled to each other vertically by connecting a lower edge of the vertical stacking side barriers 12 to the upper surface of the roller track 14 below, and a lower edge of the vertical stacking side barriers 12 to the lower surface of the roller track 14 above. Some details of the vertical stacking side barriers 12 as assembled to the respective roller tracks 14 will be further explained below with reference to FIGS. 5 and 6.

Figure 5:
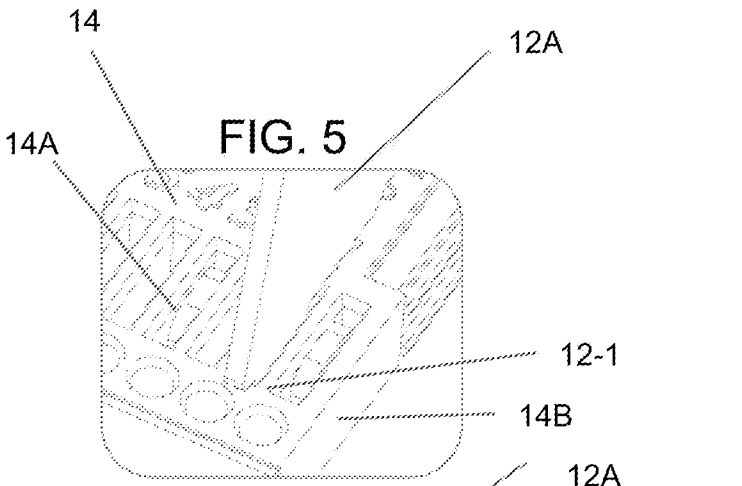
FIG. 5 shows an enlarged view of part of the assembly in FIG. 4.
Figure 6:
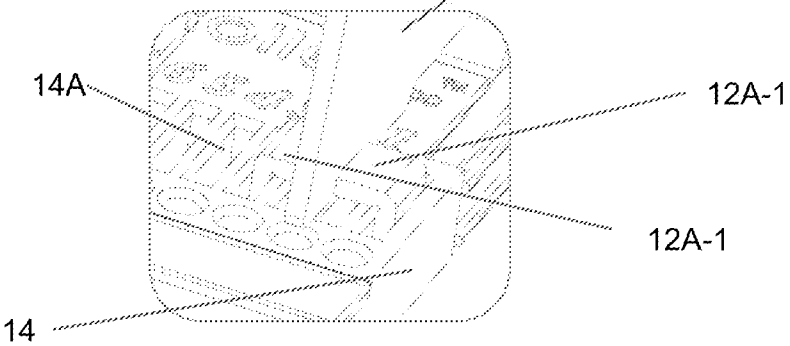
FIG. 6 shows an enlarged view of part of the assembly in FIG. 4.

FIG. 5 shows an enlarged view of the upper surface of the roller track 14 located below another example embodiment of the vertical stacking side barrier 12A. The vertical stacking side barrier 12A in FIG. 5 may connect, at each of its longitudinal ends, to a respective slot or opening 14A located proximate to each longitudinal end of one of the roller tracks 14. The connection may be made by a protrusion, e.g., a tab or prong 12-1 protruding from the respective edge of the vertical stacking side barrier 12A. Note that the tab or prong 12-1 is disposed in the slot or opening 14A being one position inward from the lateral edge 14B of the roller track 14, leaving an open slot or opening 14A proximate the lateral edge 14B of the roller track 14. FIG. 6 shows the lower surface of the same roller track 14 when it is disposed above the vertical stacking side barrier 12A when there is a layer below the illustrated roller track 14. The upper edge of such vertical stacking side barrier 12A may in some embodiments comprise two, laterally spaced apart protrusions, e.g., tabs or prongs 12A-1, that fit in openings, e.g., slots 14A in the lower surface of the roller track 14. The prongs 12A-1 are spaced apart such that when they engage the slots 14A on the lower surface of the roller track 14, they leave one open slot or opening 14A spaced between them. The roller tracks 14 may comprise a plurality of such laterally spaced slots 14A at each longitudinal end of the roller tracks 14, on both the respective lower surface and upper surface. The slots 14A may extend entirely through the longitudinal ends to provide such openings in both the upper surface and the lower surface of the roller track 14. In such way, the slots 14A may engage tabs, prongs or protrusions from a side barrier or lane divider affixed to the upper surface and/or to the lower surface of the roller track 14. In some embodiments, the tabs, prongs or protrusions on either or both the lane dividers (13 in FIG. 1, if used) and the vertical stacking side barriers 12, 12A may be long enough to substantially fill the depth of the slots 14A. Such length of the prongs or protrusions may provide increased structural strength and rigidity to a modular structure made explained herein, however such length may also preclude having a vertical stacking side barrier 12 and/or lane divider 13 disposed on both the upper surface and the lower surface of any roller track 14 at the same lateral slot or opening position unless provision is made for the position of the prongs or protrusions on the respective vertical stacking side barriers and/or lane dividers. Some embodiments of vertical stacking side barriers and/or lane dividers may have offset prongs or protrusions as explained with reference to FIG. 6, and as will be further explained with reference to other example embodiments below.

The laterally outermost prong 12A-1 may be disposed in the laterally outermost slot or opening 14A in the roller track 14 as shown in FIG. 6, such that the slot or opening 14A one space laterally inward remains open. The open slot or opening 14A may be used by the prong 12-1 on a succeeding vertical stacking side barrier 12A attached to the upper surface of the same roller track 14 as shown in FIG. 6. Thus, the same configuration or embodiment of vertical stacking side barriers 12 may be used for any chosen number or vertically stacked layers (11 in FIG. 4). Expressed more generally, and as will be explained with reference to FIG. 16, the prongs or protrusions on either or both the upper edge or the lower edge of the vertical stacking side barrier 12A may be laterally displaced from the plane of such barrier to enable mounting vertical stacking side barriers in the same lateral position among the various layers in any display assembly.

Figures 7, 8, 9:
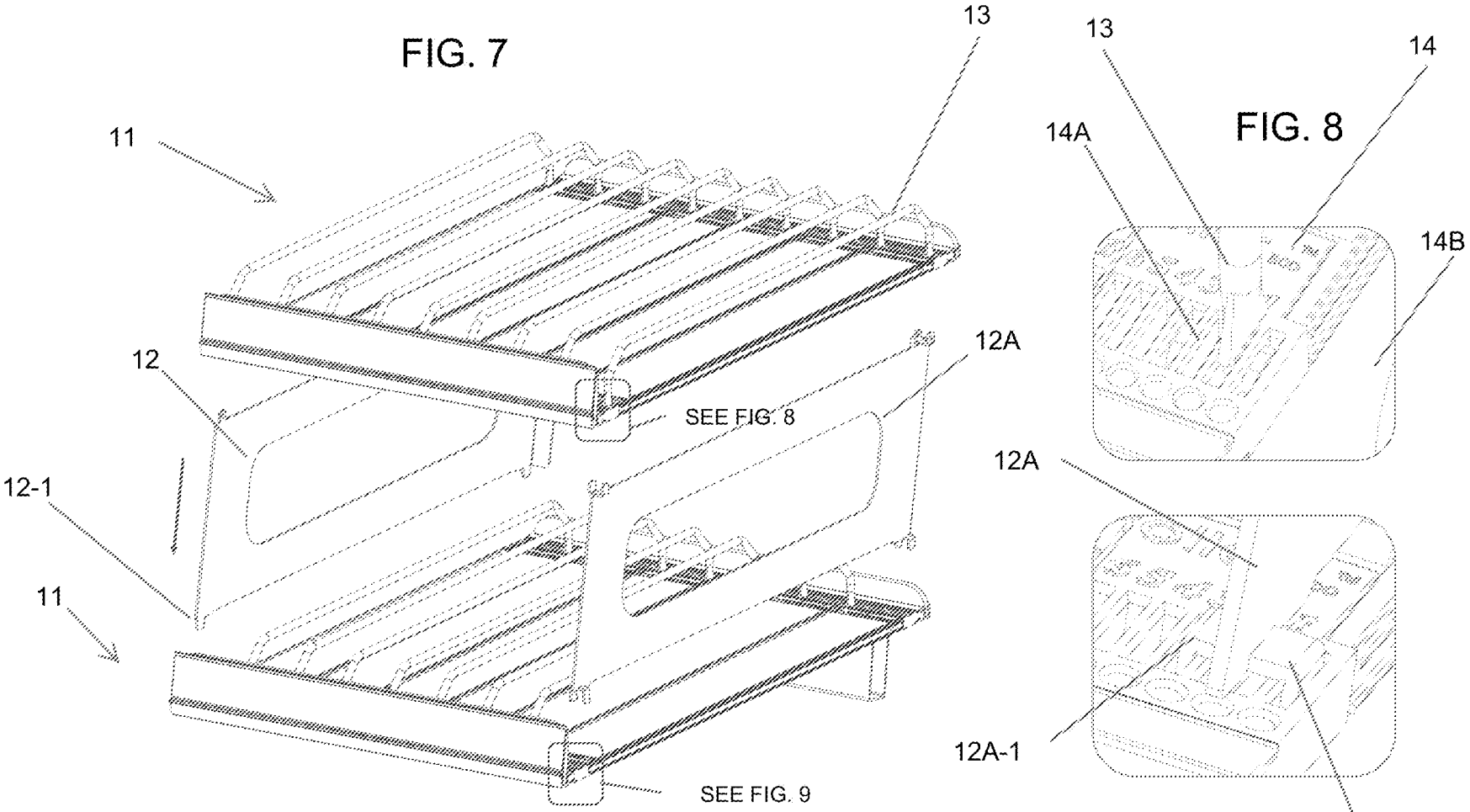
FIG. 7 shows an assembly similar to the right hand side of the vertically stacked display assembly of FIG. 1.
FIG. 8 shows an enlarged view of part of the assembly in FIG. 7.
FIG. 9 shows an enlarged view of part of the assembly in FIG. 7.

Another example embodiment will now be explained with reference to FIGS. 7, 8 and 9. FIG. 7 shows an exploded view of a display assembly, which may be similar in structure to the second display assembly explained with reference to FIG. 1. FIG. 7 shows the locations within the display assembly of more detailed views shown in FIGS. 8 and 9. The embodiment shown in FIG. 7 may comprise two layers 11, however the features shown with reference to the uppermost layer 11 (explained with reference to FIG. 8) and any one or more vertically stacked layers 11 below the uppermost layer 11 (explained with reference to FIG. 9) may be common to all such embodiments. The uppermost layer 11 may comprise only lane dividers 13 as explained previously, even at the outer lateral edges of the display assembly.

FIG. 8 shows attachment of one longitudinal end of a lane divider 13 to the upper surface of the roller track 14 in the uppermost layer 11. The lane divider 13 may be attached to the roller track 14 at the slot or opening 14A one or more positions inward from the lateral edge 14B of the roller track 14. The attachment may therefore be similar to the attachment of the vertical stacking side barrier 12A shown in and explained with reference to FIG. 5. The open slot or opening 14A at the lateral edge 14B of the roller track 14 may be used for connection to the tabs, prongs or protrusions 12A-1 of one of the vertical stacking side barriers 12A in the layer below the uppermost layer 11. In the embodiment shown in FIG. 7, FIG. 8 and FIG. 9, the vertical stacking side barriers 12A may comprise two, spaced apart tabs, prongs or protrusions 12A-1 on both the upper edge and the lower edge of such vertical stacking side barrier 12A. Such embodiments of the vertical stacking side barrier 12A may also be used to laterally connect adjacent modules to form a display system, as explained with reference to FIG. 2.

Figure 10:
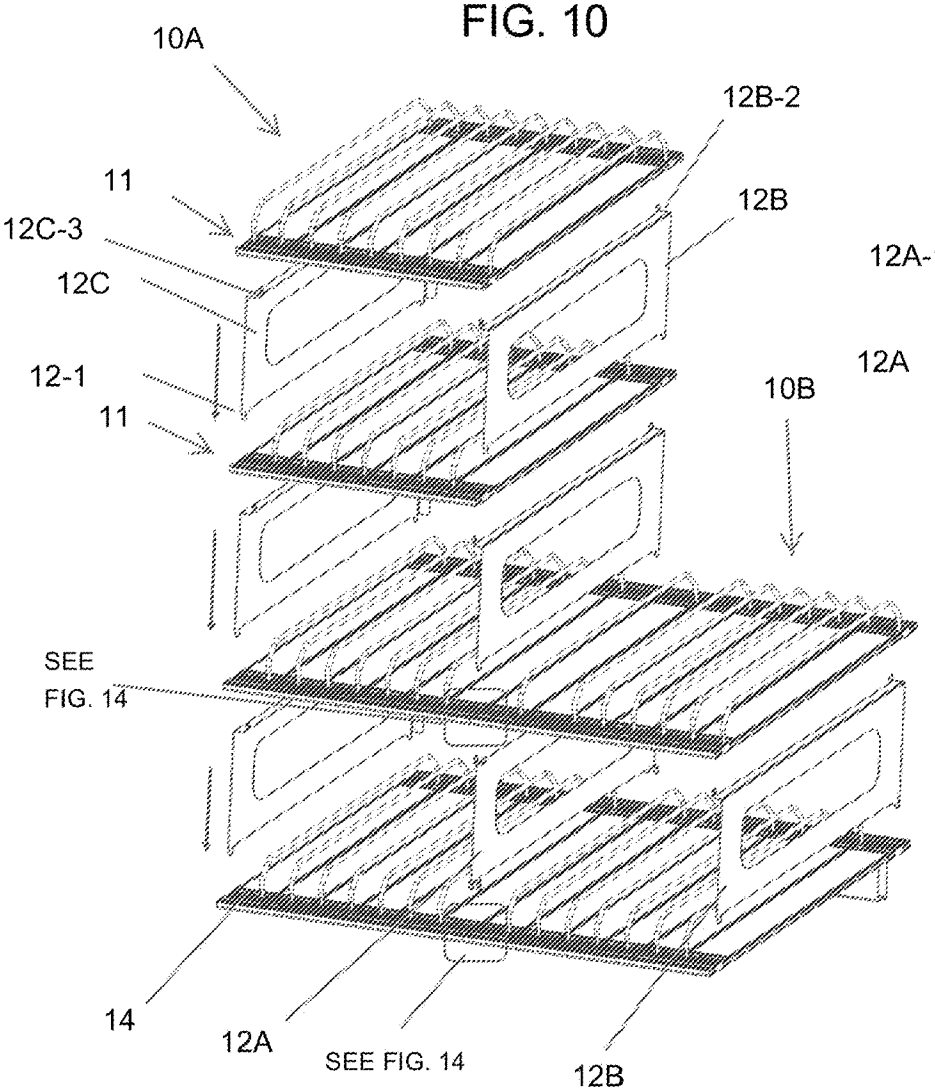
FIG. 10 shows an exploded view of the assembly in FIG. 2.

FIG. 10 shows an exploded view of the example embodiment of a display system explained with reference to FIG. 2. A first module 10A comprising four vertically stacked layers 11 may be laterally connected to a second module 10B comprising two vertically stacked layers 11. Laterally outward most edges between the upper two layers 11 in the first module 10A may comprise another example embodiment of the vertical stacking side barriers, shown at 12B and 12C. Such embodiment of the vertical stacking side barriers 12B, 12C may comprise a single tab, prong or protrusion 12-1 at each longitudinal end extending from the lower edge of the vertical stacking side barrier 12B, 12C, and laterally inwardly offset tabs, prongs or protrusions 12C-3, 12B-2, respectively, for the vertical stacking side barriers 12C, 12B, extending from the upper edge thereof. The offset tabs, prongs or protrusions 12C-3, 12B-2 extending from the upper edge may be offset by one or more roller track slot locations (see FIG. 12 and FIG. 14) from the plane of the vertical stacking side barrier 12C, 12B, while the tabs, prongs or protrusions 12-1 on the lower edge may be coplanar with the vertical stacking side barrier 12B, 12C. The offset tabs, prongs or protrusions 12C-3, 12B-2 may leave an open slot or opening in the (lower surface of the) vertically successive roller track 14 so that as many layers as desired may be assembled vertically, supported between adjacent layers by the vertical stacking side barriers 12B, 12C. Although the vertical stacking side barriers 12B, 12C in FIG. 10 may appear to be "handed", it will be apparent that the vertical stacking side barriers 12B, 12C may be made longitudinally symmetrically, such that longitudinally reversing the vertical stacking side barriers 12B, 12C will enable their use on either lateral edge of any module. In the location where the two-layer (second) module 10B is to be laterally connected or joined to the four layer module, the vertical stacking side barrier 12A may be of similar form as that explained with reference to FIG. 7, wherein the vertical stacking side barrier 12A may comprise two laterally spaced apart tabs, prongs or protrusions (12A-1 in FIG. 11) at each longitudinal end and on both upper and lower edges.

Figure 12:
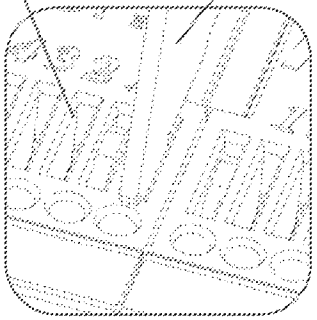
FIG. 12 shows an enlarged view of part of the assembly in FIG. 10.
Figure 11:
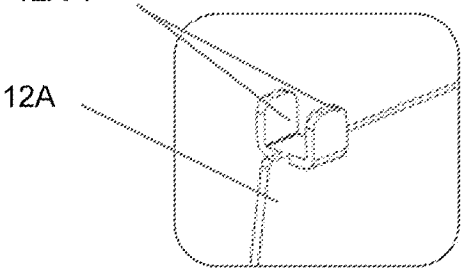
FIG. 11 shows an enlarged view of part of the assembly in FIG. 10.
Figure 14:
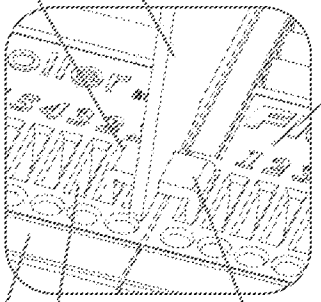
FIG. 14 shows an enlarged view of part of the assembly in FIG. 10.
Figure 13:
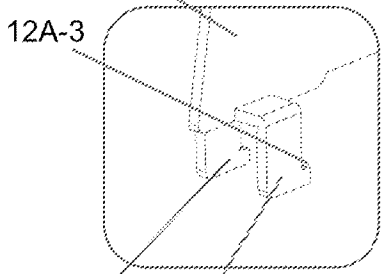
FIG. 13 shows an enlarged view of part of the assembly in FIG. 10.

Referring to FIG. 14, it may be observed that in some embodiments the vertical stacking side barrier 12 may be used to laterally connect two adjacent roller tracks 14. FIG. 11 shows an example embodiment of the vertical stacking side barrier 12A having two laterally spaced apart tabs, prongs or protrusions 12A-1 for attachment to the lower surface of the vertically successive roller track. Some embodiments, for example, may comprise two prongs or protrusions as shown in FIG. 11 at each longitudinal end on the upper edge, and only one prong 12-1 at each end on the lower edge. The foregoing embodiment may attach to the upper surface of the roller track below as shown in FIG. 12, wherein the vertical stacking side barrier 12 is disposed in the outermost slot or opening 14A, while as shown in FIG. 14, the upper edge of the vertical stacking side barrier 12 may be disposed as shown to lock together two laterally adjacent roller tracks 14. In some embodiments, as shown in FIG. 13, the two spaced apart tabs, prongs or protrusions 12A-2 may each comprise a locking tang 12A-3 to hold the respective tab, prong or protrusion 12A-2 in place in the respective slot or opening (14 in FIG. 14) for added structural stability of the assembled display system.

Figure 15:
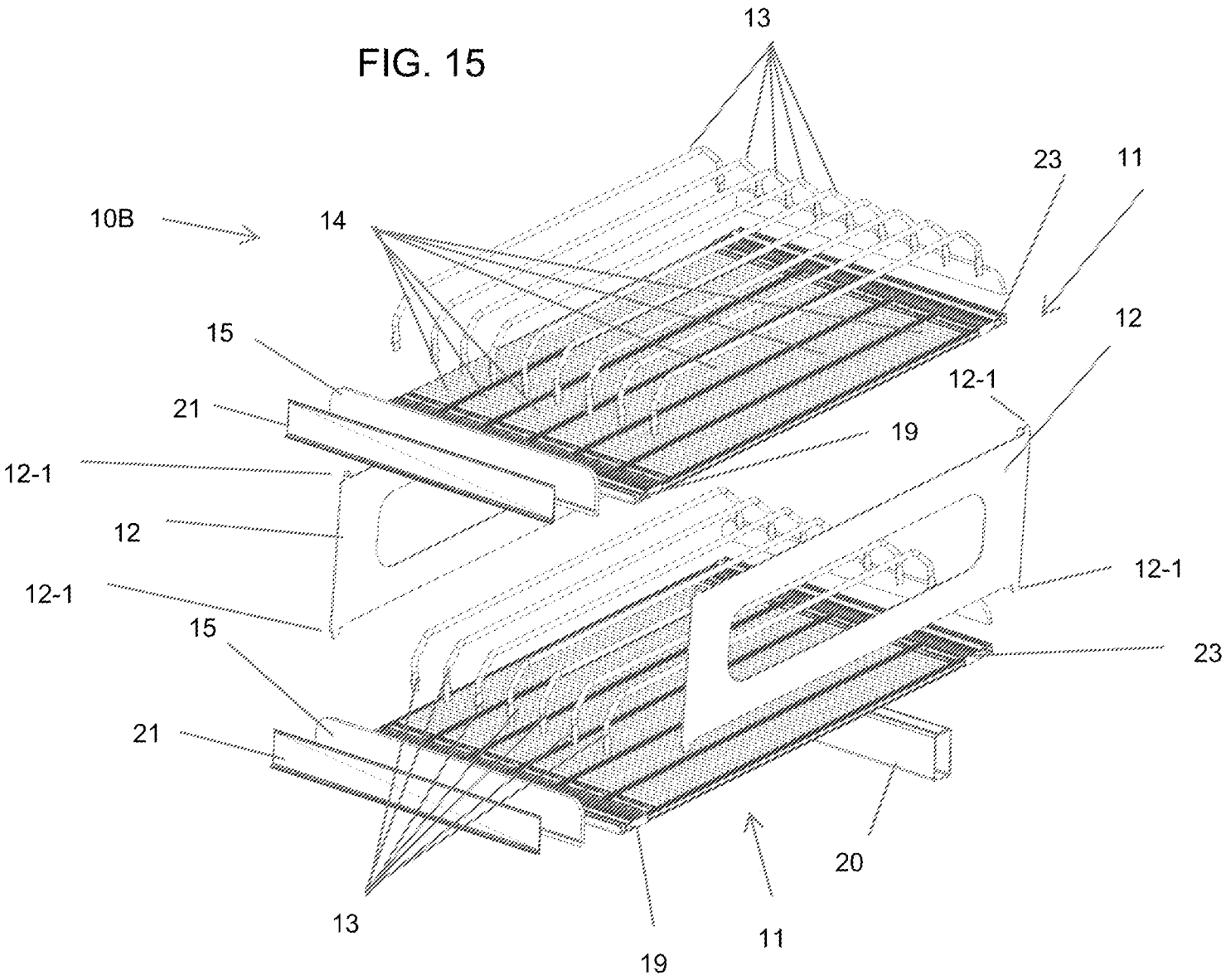
FIG. 15 shows an exploded view of an assembly to illustrate additional components.

FIG. 15 shows an exploded view of the example embodiment of the two-layer display assembly 10B explained with reference to FIG. 1. The upper layer 11 may comprise a plurality of roller tracks 14 disposed side by side. The roller tracks 14 in the upper layer 11 may comprise lane dividers 13 at selected laterally spaced apart positions, including at each lateral edge of the lateral outermost roller tracks 14. The roller tracks 14 may be supported by a front rail 19 and a rear rail 23. A front barrier 15 may be attached to the front rail 19 to limit movement or product containers on the upper layer 11. A label holder 21 may be attached to the front barrier 15.

The lower layer 11 may comprise a plurality of roller tracks disposed side by side. The roller tracks 14 in the lower layer 11 may be supported by a front rail 15 and a bracket 20. The lower layer 11 may also comprise a back rail 23 as the upper layer. Lane dividers 13 may be disposed at selected lateral positions in the roller tracks 14 as with the upper layer 11. The lateral outermost edges of the outermost roller tracks 14 may have disposed therein vertical stacking side barriers 12 in any of the previously explained forms. In embodiments having only two layers, the vertical stacking side barriers 12 may be planar and have prongs or protrusions 12-1 as explained with reference to FIG. 7. The lower layer may comprise a front barrier 15 and label holder 21 as with the upper layer 11.

Figure 16:
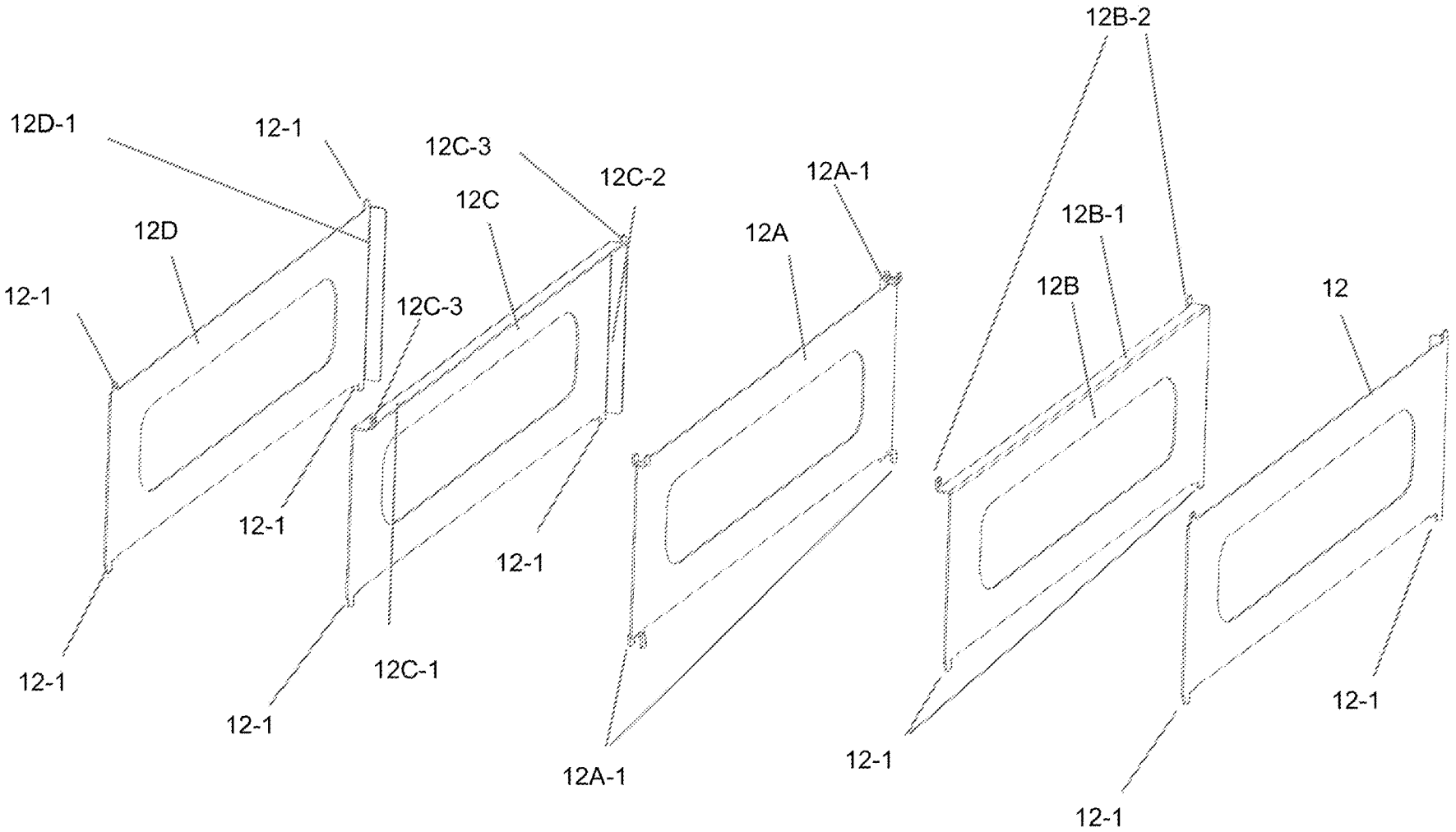
FIG. 16 shows various embodiments of side barriers that may be used in different assembly configurations.

Various embodiments of a vertical stacking side barrier are shown in and will be explained with reference to FIG. 16. A single plane embodiment is shown at 12, wherein tabs, prongs or protrusions 12-1 arranged to engage slots (14A in FIG. 14) in the roller tracks (14 in FIG. 14) are coplanar with the body of the vertical stacking side barrier 12. The single plane embodiment of vertical stacking side barrier 12 may be used, for example, in a display assembly having only two layers (11 in FIG. 1), and lane dividers (13 in FIG. 1) may be disposed any chosen location laterally inward of the laterally outward most slots (14A in FIG. 1) in the upper layer (11 in FIG. 1). For embodiments of a display assembly having more than two layers, and/or where lane dividers on the uppermost layer are required to be disposed in the laterally outermost slots, an offset stacking side barrier 12B may be used. The offset stacking side barrier 12B may comprise tabs, prongs or protrusions 12-1 on the lower edge that are coplanar with the body of the offset stacking side barrier 12B. Prongs, tabs or protrusions 12B-2 on the upper edge of the offset stacking side barrier 12B may be formed into the longitudinal ends of an offset flange 12B-1. Width of the offset flange 12B-1 may locate the tabs, prongs or protrusions 12B-2 one slot or opening inward of the later edge of the adjacent roller track (14 in FIG. 14) so that the outermost slot or opening on such roller track remains open for a lane divider (13 in FIG. 1) or a successive vertical stacking side barrier. The offset stacking side barrier shown at 12B may be "handed", such that it is affixed in the display assembly on one lateral edge, and a corresponding offset stacking side barrier 12C having mirror image features to offset stacking side barrier 12B may be affixed to the other lateral edge of the display assembly. However, embodiments of the offset stacking side barrier such as shown at 12B may be made longitudinally symmetrically, so as to avoid handedness. The example embodiment of offset stacking side barrier shown at 12C may comprise a rear flange 12C-2 to increase rigidity. Such embodiments having both a rear flange 12C-2 and an offset flange 12C-1 may be handed, and mirror image, handed offset stacking side barriers may be used in such cases. A single plane vertical stacking side barrier 12D may comprise a rear flange 12D-1, and all tabs, prongs or protrusions 12-1 used to connect to roller tracks may be coplanar with the body of the side barrier 12D.

Figure 17A:
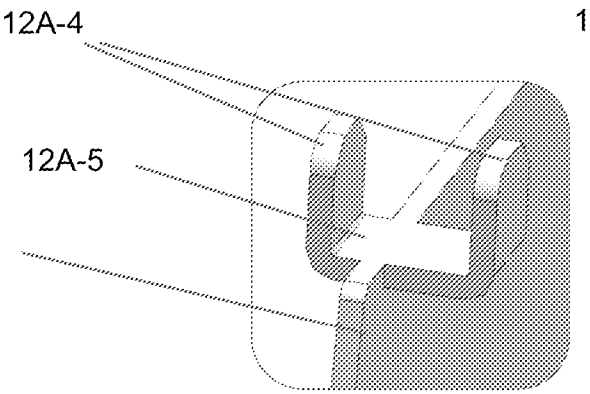
FIGS. 17A through 17D show various embodiments of prongs on a side barrier.
Figure 17B:
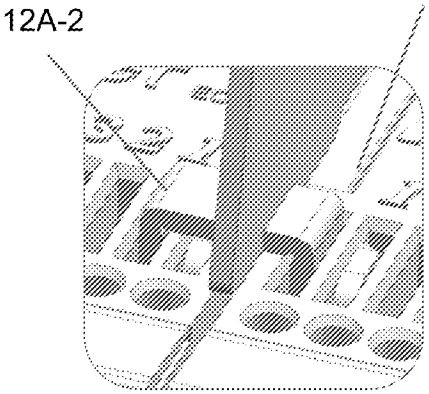
Figure 17C:
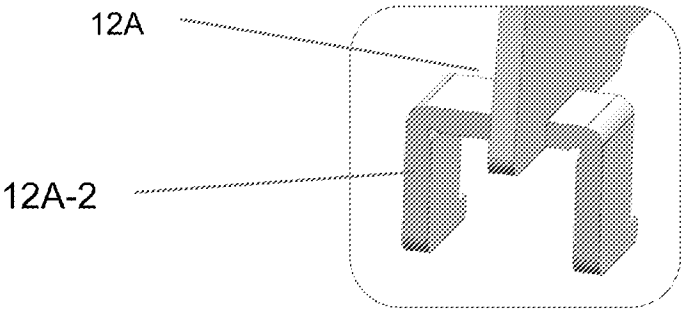
Figure 17D:
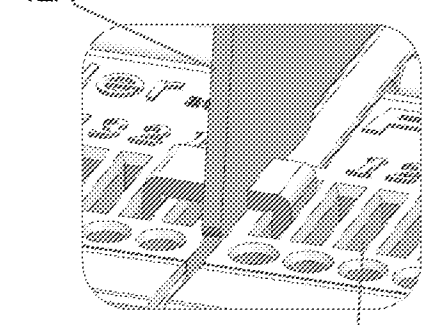

FIGS. 17A through 17D show another embodiment of a vertical stacking side barrier and how the vertical stacking side barrier may be used to join two roller tracks and/or two adjacent display assemblies together laterally. FIG. 17A shows an enlarged view of tabs, prongs or protrusions 12A-4 on an upper edge of the vertical stacking side barrier 12A. It may be observed that the tabs, prongs or protrusions 12A-4 are laterally spaced apart, and a center point 12A-5 between the tabs, prongs or protrusions 12A-4 is displaced from the body plane of the vertical stacking side barrier 12A. Prongs, tabs or protrusions on the lower edge of the vertical stacking side barrier 12A are shown at 12A-2 in FIG. 17C. Such tabs, prongs or protrusions 12A-2 correspond to the tabs, prongs or protrusions shown in FIG. 13 to lock the stacking side barrier 12A into the upper surface of one or more roller tracks (14 in FIG. 17D), by seating the tabs, prongs or protrusions 12A-2 in respective spaced apart slots (14A in FIG. 17D) in the roller track (14 in FIG. 17D). The lower edge tabs, prongs or protrusions 12A-2 may be symmetric with respect to the plane of the vertical stacking side barrier 12A, and may therefore be displaced laterally from the tabs, prongs or protrusions 12A-4 on the upper edge by one or more slot locations (14A in FIG. 17D) from the prongs or protrusions 12A-2 on the lower edge. The vertical stacking side barrier 12A in FIGS. 17A through 17D therefore may be affixed to one or more roller tracks 14. As shown in FIG. 17B, two roller tracks are joined laterally by the tabs, prongs or protrusions 12A-2, wherein one such prong is located in a corresponding slot or opening in one roller track 14, and the other prong is located in the adjacent roller track 14 However, because the upper-edge prongs or protrusions 12A-4 are laterally displaced with respect to the lower edge prongs or protrusions 12A-2, different slots are occupied by the respective prongs or protrusions 12A-4, 12A-2. In this way, the prongs or protrusions 12A-2, 12A-4 may fill the thickness of the respective slots 14A while enabling stacking of layers (11 in FIG. 1) both above and below any other layer. As explained above, the slots in any embodiment of the roller track may extend completely through the roller track.

Figure 20:
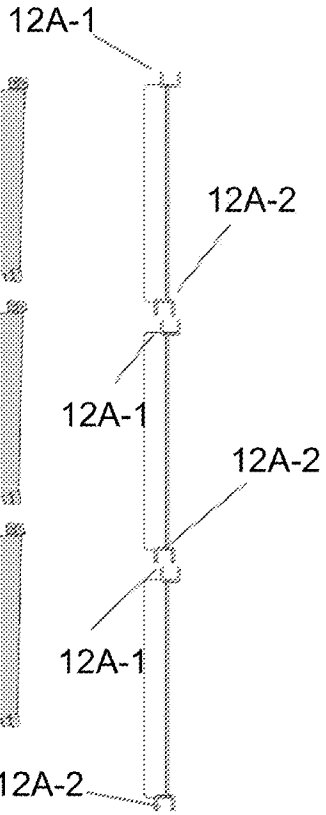
FIGS. 18 through 20 show two display assemblies linked together laterally using one embodiment of side barrier.
Figure 18:
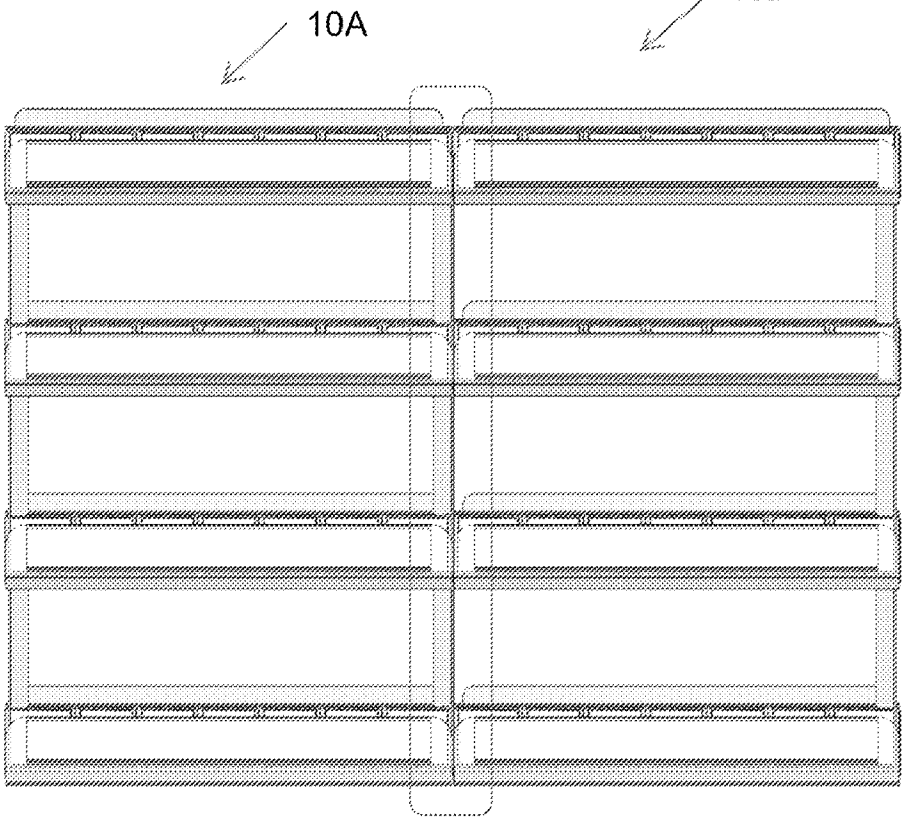

FIG. 18 shows an example embodiment of a display system comprising a first display assembly 10A joined laterally to a second display assembly 10B. The first and second display assemblies 10A. 10B may be laterally joined using, for example, an embodiment of vertical stacking side barrier shown in FIG. 19 at 12A. The vertical stacking side barriers 12A may comprise symmetric, laterally spaced apart tabs, prongs or protrusions 12A-1, 12A-2 on the respective upper and lower edges. Using such vertical stacking side barriers 12A, to laterally join two adjacent display assemblies 10A, 10B, the vertical stacking side barriers 12A may be staggered laterally as shown in FIG. 20 so that slots (14A in FIG. 17D) in the respective roller tracks 14 may be fully filled by tabs, prongs or protrusions from only one vertical stacking side barrier 12A disposed on an upper surface of the roller track 14, and by tabs, prongs or protrusions from a different vertical stacking side barrier 12A disposed on a lower surface of the same roller track 14 as shown in FIG. 20. It may be observed in FIG. 20 that using the present example embodiment of a vertical stacking side barrier 12A results in the vertical stacking side barriers being located in different lateral positions between adjacent layers (11 in FIG. 1). In some embodiments, single prong vertical stacking side barriers, as explained with reference to 12 in FIG. 16, may be used in the same manner as the vertical stacking side barriers 12A shown in FIG. 20.

Figure 21:
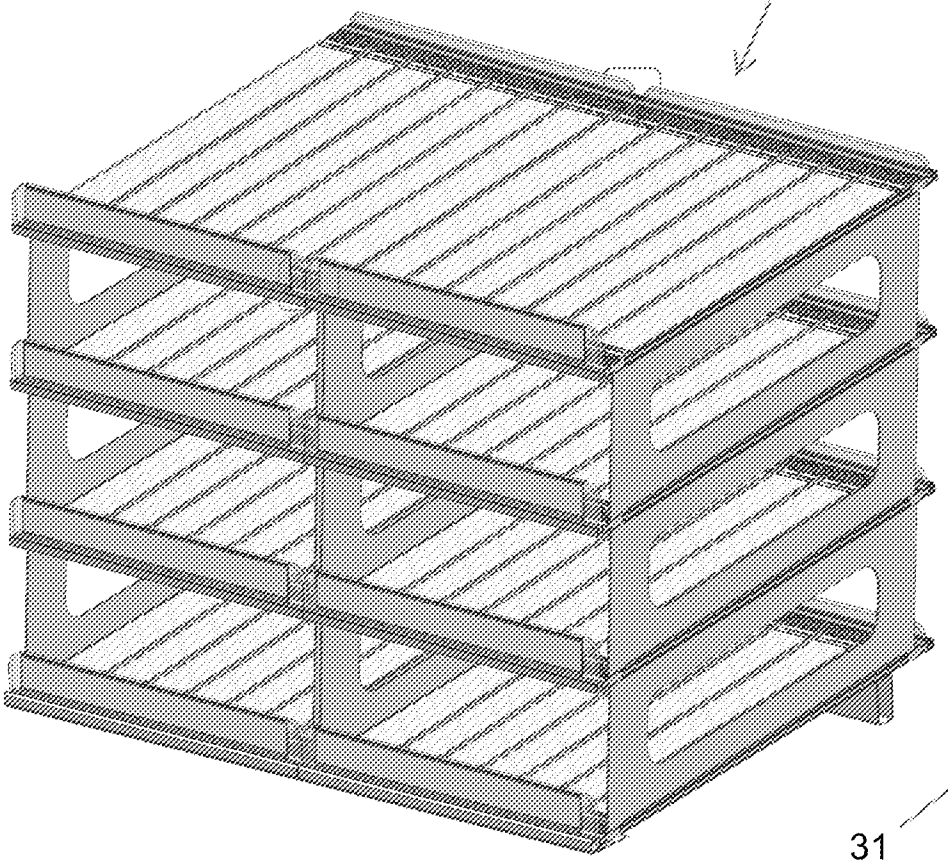
FIGS. 21, 22 and 23 show two display assemblies linked together laterally using joining clips, and an example embodiment of a joining clip, respectively.
Figure 22:
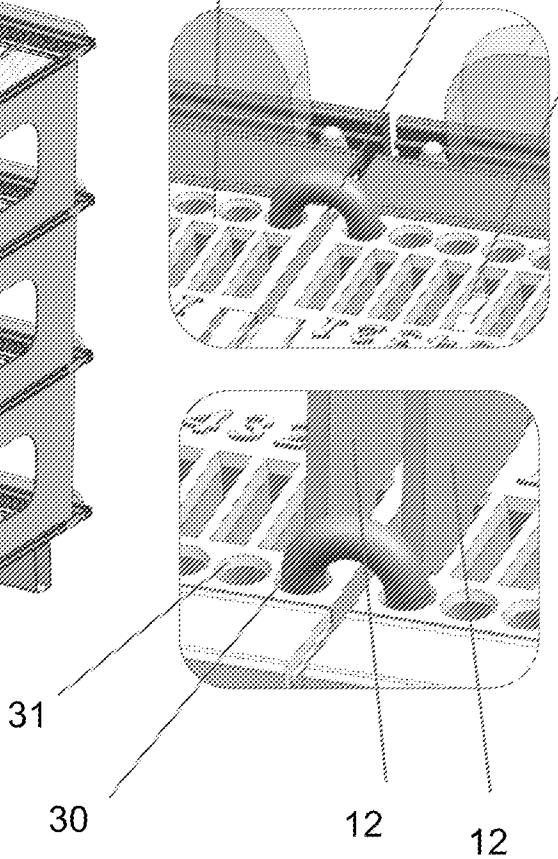
Figure 23:
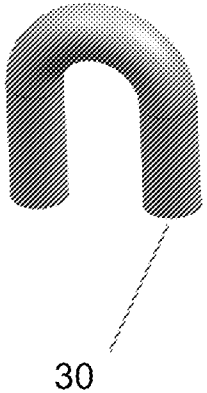
Figure 24A:
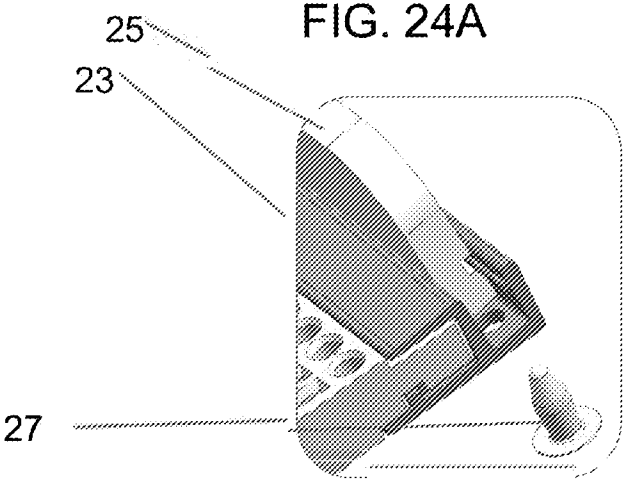
FIGS. 24A through 24D show push pins used to hold a rear barrier in place in a rear rail attached to a roller track.
Figure 24B:
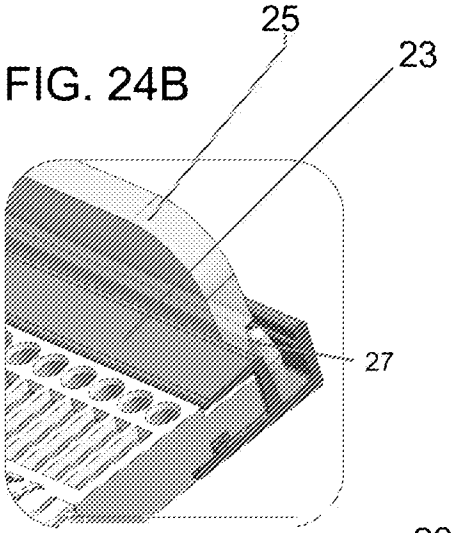
Figure 24C:
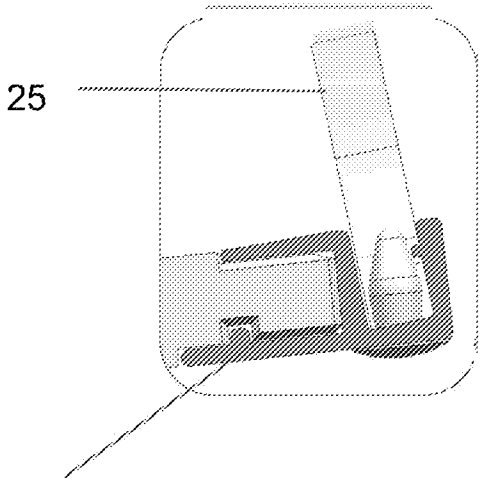
Figure 24D:
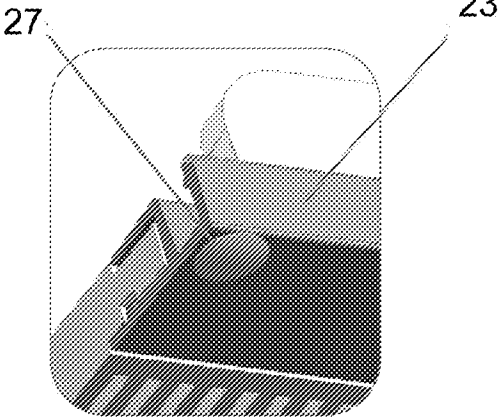

FIGS. 21, 22 and 23 illustrate another possible embodiment used to link, connect or join adjacent display assemblies. FIG. 21 shows a first display assembly 10A laterally adjacent to and linked with or connected to a second display assembly 10B. The first and second display assemblies 10A, 10B may comprise multiple layers as explained with reference to FIG. 2, and the number of such layers may be the same or different between the two display assemblies 10A, 10B. Referring to FIG. 22, the roller tracks 14, in addition to the slots (14A in FIG. 17D) used to accept vertical stacking side barriers and/or lane dividers may further comprise round openings 31. A joining clip 30 may be in the shape of a U as shown, or shaped in any other form to have two, laterally spaced apart pins that are linked together and fit in respective spaced apart openings 31 in one or more roller tracks. As shown in FIG. 22, the joining clips 30 may fit into openings 31 in two adjacent roller tracks 14 and may therefore be used to laterally join two adjacent display assemblies. In such embodiments, any one or more of the vertical stacking side barriers 12 may be a "single plane" version as explained with reference to FIG. 16, and may be staggered as explained with reference to FIG. 20 between adjacent layers. FIG. 23 shows an enlarged view of one of the joining clips 30, which may be formed from wire, molded plastic or any other suitable material to provide the required structural strength to join adjacent display assemblies.

FIGS. 24A through 24D show a rear barrier 25 disposed in a slot or opening formed for such purpose in a rear rail 23. The rear barrier 25 may be mounted to the rear rail 23 by sliding into a slot or opening 29. The rear barrier 25 may comprise a groove 25A extending along one surface that can engage a tongue or other protrusion 29A extending from a corresponding surface in the rear rail 23. Engagement of the tongue 29A with the groove 25A secures the rear barrier 25 vertically within the rear rail 23. Push pins 27 may be inserted into corresponding openings 27A in the lateral edges of the rear rail 23 to hold the rear barrier 25 in place after assembly.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A modular product display system, comprising:

at least a first module comprising at least two vertically stacked layers, each layer comprising at least one roller track supported on one longitudinal end by a rail such that the one longitudinal end is at a different elevation than another longitudinal end of the at least one roller track; and at least two vertical stacking side barriers disposed at laterally spaced apart positions between the at least one roller track in each of the at least two vertically stacked layers, the at least two vertical stacking side barriers having protrusions on an upper edge and a lower edge engageable with corresponding openings in the at least one roller track, wherein (i) the protrusions on at least one of the upper edge and the lower edge are non-coplanar with a plane of the vertical stacked side barrier, or (ii) the protrusions on the vertical stacked side barriers between the at least two vertically stacked layers are laterally displaced from corresponding protrusions on corresponding vertical stacked side barriers between at least one further vertically stacked layer.

2. The system of claim 1 wherein the protrusions on at least one of the upper edge and the lower edge comprise laterally spaced apart protrusions.

3. The system of claim 2 wherein the protrusions on at least one of the lower edge and the upper edge comprise single protrusions laterally displaced from the protrusions on an opposed one of the lower edge and the upper edge.

4. The system of claim 2 wherein the laterally spaced apart protrusions are disposed symmetrically with respect to the plane of the vertical stacking side barrier.

5. The system of claim 2 wherein the laterally spaced apart protrusions are disposed asymmetrically with respect to the plane of the vertical stacking side barrier.

6. The system of claim 1 wherein a length of the protrusions is selected to substantially fill an entire thickness of respective openings in the at least one roller track.

7. The system of claim 1 further comprising at least a second module adjacent to and joined to the at least a first module, the at least a second module comprising at least two vertically stacked layers, each layer in the at least a second module comprising at least one roller track supported on one longitudinal end by a rail such that the one longitudinal end is at a different elevation than another longitudinal end of the at least one roller track; and at least two vertical stacking side barriers in the at least a second module disposed at laterally spaced apart positions between the at least one roller track in each of the at least two vertically stacked layers in the at least a second module, the at least two vertical stacking side barriers in the at least a second module having protrusions on an upper edge and a lower edge engageable with corresponding openings in the at least one roller track, wherein (i) the protrusions on at least one of the upper edge and the lower edge are displaced from a plane of the vertical stacked side barrier, or (ii) the protrusions on the vertical stacked side barriers between the at least two vertically stacked layers are laterally displaced from corresponding protrusions on corresponding vertical stacked side barriers between at least one further vertically stacked layer in the at least a second module.

8. The system of claim 7 wherein the at least a first module and the at least a second module are joined by laterally spaced apart protrusions on at least one of the vertical stacking side barriers coupled to adjacent roller tracks in in the at least a first and the at least a second module.

9. The system of claim 7 wherein the at least a first module and the at least a second module are joined by joining clips coupled to adjacent roller tracks in the at least a first and the at least a second module.

10. A modular product display system, comprising:

at least a first module comprising at least two vertically stacked layers, each layer comprising at least one roller track supported on one longitudinal end by a rail such that the one longitudinal end is at a different elevation than another longitudinal end of the at least one roller track at least a second module adjacent to and joined to the at least a first module, comprising at least two vertically stacked layers, each layer comprising at least one roller track supported on one longitudinal end by a rail such that the one longitudinal end is at a different elevation than another longitudinal end of the at least one roller track;

wherein each of the at least a first module and the at least a second module comprises at least two vertical stacking side barriers disposed at laterally spaced apart positions between the at least one roller track in each of the at least two vertically stacked layers, the at least two vertical stacking side barriers having protrusions on an upper edge and a lower edge engageable with corresponding openings in the at least one roller track, wherein (i) the protrusions on at least one of the upper edge and the lower edge are displaced from a plane of the vertical stacked side barrier, or (ii) the protrusions on the vertical stacked side barriers between the at least two vertically stacked layers are laterally displaced from corresponding protrusions on corresponding vertical stacked side barriers between at least one further vertically stacked layers; and wherein the at least a first module and the at least a second module are joined by laterally spaced apart protrusions on at least one of the vertical stacking side barriers coupled to adjacent roller tracks in in the at least a first and the at least a second module.

11. The system of claim 10 wherein the protrusions on at least one of the upper edge and the lower edge comprise laterally spaced apart protrusions.

12. The system of claim 11 wherein the protrusions on at least one of the lower edge and the upper edge comprise single protrusions laterally displaced from the protrusions on an opposed one of the lower edge and the upper edge opposed edge.

13. The system of claim 11 wherein the laterally spaced apart protrusions are disposed symmetrically with respect to the plane of the vertical stacking side barrier.

14. The system of claim 11 wherein the laterally spaced apart protrusions are disposed asymmetrically with respect to the plane of the vertical stacking side barrier.

15. The system of claim 10 wherein a length of the protrusions is selected to substantially fill an entire thickness of respective openings in the at least one roller track.

* * * * *